US007517408B2

(12) United States Patent
Hou et al.

(10) Patent No.: US 7,517,408 B2
(45) Date of Patent: Apr. 14, 2009

(54) APPARATUS AND METHOD OF MANUFACTURING A HEAT PIPE

(75) Inventors: Chuen-Shu Hou, Tu-Cheng (TW); Chao-Nien Tung, Tu-Cheng (TW); Tay-Jian Liu, Tu-Cheng (TW); Cheng-Chi Lee, Tu-Cheng (TW)

(73) Assignee: Foxconn Technology Co., Ltd., Tu-Cheng, Taipei Hsien (TW)

( * ) Notice: Subject to any disclaimer, the term of this patent is extended or adjusted under 35 U.S.C. 154(b) by 313 days.

(21) Appl. No.: 11/309,070

(22) Filed: Jun. 15, 2006

(65) Prior Publication Data

US 2007/0074600 A1 Apr. 5, 2007

(30) Foreign Application Priority Data

Sep. 23, 2005 (CN) ..... 2005 1 0037487

(51) Int. Cl.

| | |
|---|---|
| ***B05C 19/00*** | (2006.01) |
| ***B05C 13/06*** | (2006.01) |
| ***B23P 6/00*** | (2006.01) |
| ***F28D 15/00*** | (2006.01) |

(52) U.S. Cl. ..... 118/308; 118/306; 118/317; 29/890.032; 165/104.06

(58) Field of Classification Search ..... 118/308, 118/309, 306, 317, DIG. 10; 29/890.032, 29/897.2, 46, 830.1; 165/80.4, 104.26; 175/40; 419/10; 505/231; 148/676; 514/521; 427/180, 427/230

See application file for complete search history.

(56) References Cited

U.S. PATENT DOCUMENTS 4,196,504 A * 4/1980 Eastman ..... 29/890.032
5,873,408 A * 2/1999 Bellet et al. ..... 165/84

FOREIGN PATENT DOCUMENTS

TW 1258560 7/2006

* cited by examiner

*Primary Examiner*—Yewebdar T Tadesse
(74) *Attorney, Agent, or Firm*—Frank R. Niranjan

(57) ABSTRACT

A powder feeding apparatus of manufacturing a heat pipe includes a vibration tray having a supporting board and a plurality of pipes positioned in the supporting board of the tray. A mandrel is coaxially inserted in each of the pipes. A feeder is located corresponding to an end of each pipe for feeding powder into the pipe. A vibration source is located under the tray to drive the tray to vibrate with substantially a same amplitude in a vibration direction when feeding the powder into the pipes from the feeder.

6 Claims, 5 Drawing Sheets

APPARATUS AND METHOD OF MANUFACTURING A HEAT PIPE

FIELD OF THE INVENTION

The present invention relates generally to an apparatus and a method of manufacturing a heat pipe, and more particularly to an apparatus and a method of manufacturing a heat pipe having a sintered wick structure.

DESCRIPTION OF RELATED ART

Heat pipes have excellent heat transfer performance due to their low thermal resistance, and therefore are an effective means for transferring or dissipating heat from heat sources. Currently, the heat pipes are widely used for removing heat from heat-generating components such as central processing units (CPUs) of computers. A heat pipe is generally a vacuum-sealed pipe. A wick structure is provided on an inner wall of the pipe, and at least a phase changeable working media employed to carry heat is filled in the pipe. Generally, according to positions from which heat is input or output, the heat pipe is defined with three sections, which are evaporating section, condensing section and adiabatic section between the evaporating section and the condensing section.

In use, the heat pipe transfers heat from one place to another place mainly by virtue of phase change of the working media taking place therein. Generally, the working media is liquid such as alcohol, water and so on. When the working media in the evaporating section of the heat pipe is heated up, it vapors, and pressure difference is thus produced between the evaporating section and the condensing section in the heat pipe. Resultant vapor with high enthalpy rushes to the condensing section and condenses there. Then the condensed liquid reflows to the evaporating section along the wick structure. This evaporating/condensing cycle repeats in the heat pipe; consequently, heat is transferred from the evaporating section to the condensing section continually. Due to the continual phase change of the working media, the evaporating section is kept at or near the same temperature as the condensing section of the heat pipe. The heat pipe is used widely owing to its great heat-transfer capability.

The wick structure currently available for the heat pipe includes fine grooves integrally formed at the inner wall of the heat pipe, screen mesh or bundles of fiber inserted into the heat pipe and held against the inner wall thereof, or sintered powder combined to the inner wall of the heat pipe by sintering process. Among these wicks, the sintered wick is preferred to the other wicks with respect to heat transfer ability and ability against gravity.

It is known that porosity and void size of the sintered wick structure are important parameters for the heat transfer capacity of the heat pipe. Packing density of the powder before being sintered is an important factor to affect the porosity, void size, wick strength, sintering temperature, seepage force and capillary force of the wick structure of the heat pipe.

Originally, the pipes have powder fed thereinto mainly by manual force, which results in low manufacturing yield and uneven packing density of the powder in the pipes. In order to overcome the disadvantage of manual process, automatization system is used to feed powder into the pipes. Referring to FIG. 5, a conventional powder feeding apparatus for manufacturing a heat pipe is illustrated. In the apparatus, a vibratory tray 4 is used. The tray 4 mechanically connects with a vibratory source 6 located beside the tray 4. The tray 4 comprises opposite upper and low supporting boards 41, 42 at top and bottom thereof, and a pair of sidewalls 43 connecting with corresponding ends of the upper and lower supporting boards 41, 42. The upper and low supporting boards 41, 42 define a plurality of corresponding through holes (not labeled) therein. A plurality of pipes 3 is positioned in the through holes of the upper and lower supporting boards 41, 42. A mandrel 2 is inserted in each pipe 3. Sintering powder 5 is fed to funnels 1 disposed at upper ends of the pipes 3. The vibratory source 6 works and drives the tray 4 to vibrate up and down, as indicated by arrows E, F shown in FIG. 5, i.e., vibrating along an axial direction of the pipes 3, to thereby deposit the powder 5 into the pipes 3 at a certain speed from the funnels 1. However, the vibratory source 6 which is located at a side of the tray 4 and drives the tray 4 to vibrate in vertical direction, arises a problem that the tray 4 has different amplitudes of vibration. The pipes adjacent to the vibratory source 6 have smaller amplitudes of vibration and have smaller amount of powder 5 deposited in the pipes 3, while the pipes 3 remote from the vibratory source 6 have larger amplitudes of vibration and have larger amount of powder 5 deposited in the pipes 3. As a result, in the same lot, the pipes 3 have different amount of powder fed therein and have different wick structures after the powder 5 is sintered. This causes the heat pipes made therefrom to have an uneven quality.

Therefore, it is desirable to provide a powder feeding apparatus and method of manufacturing a heat pipe which can over the shortcomings of the conventional art.

SUMMARY OF THE INVENTION

A powder feeding apparatus of manufacturing a heat pipe in accordance with a preferred embodiment of the present invention comprises a vibration tray having a supporting board and a plurality of pipes positioned in the supporting board of the tray. A vibration source is located under the vibration tray for driving the vibration tray to vibrate. A mandrel is coaxially inserted in each of the pipes. A feeder is located corresponding to an end of each pipe for feeding powder into the pipe. The vibration source drives the tray to vibrate with substantially a same amplitude in a vibration direction when feeding the powder into the pipes from the feeders.

The present invention in another aspect, relates to a method of manufacturing a heat pipe, comprising steps: 1) proving a vibration tray connecting with a vibration source located under the vibration tray; 2) positioning a plurality of pipes in the vibration tray; 3) inserting a mandrel into each of the pipes; 4) positioning a feeder corresponding to each of the pipes; 5) starting the vibration source to drive the vibration tray to vibrate with substantially a same amplitude in a vibration direction, and feeding powder into the pipes from the feeders; 6) sintering the powder in the pipes; 7) extracting the mandrels from the pipes, filling working media into the pipes, vacuuming and sealing the pipes.

Other advantages and novel features of the present invention will become more apparent from the following detailed description of preferred embodiment when taken in conjunction with the accompanying drawings, in which:

BRIEF DESCRIPTION OF THE DRAWINGS

Many aspects of the present apparatus and method can be better understood with reference to the following drawings. The components in the drawings are not necessarily drawn to scale, the emphasis instead being placed upon clearly illustrating the principles of the present apparatus and method.

Moreover, in the drawings, like reference numerals designate corresponding parts throughout the several views.

DETAILED DESCRIPTION OF THE INVENTION

Figure 1:
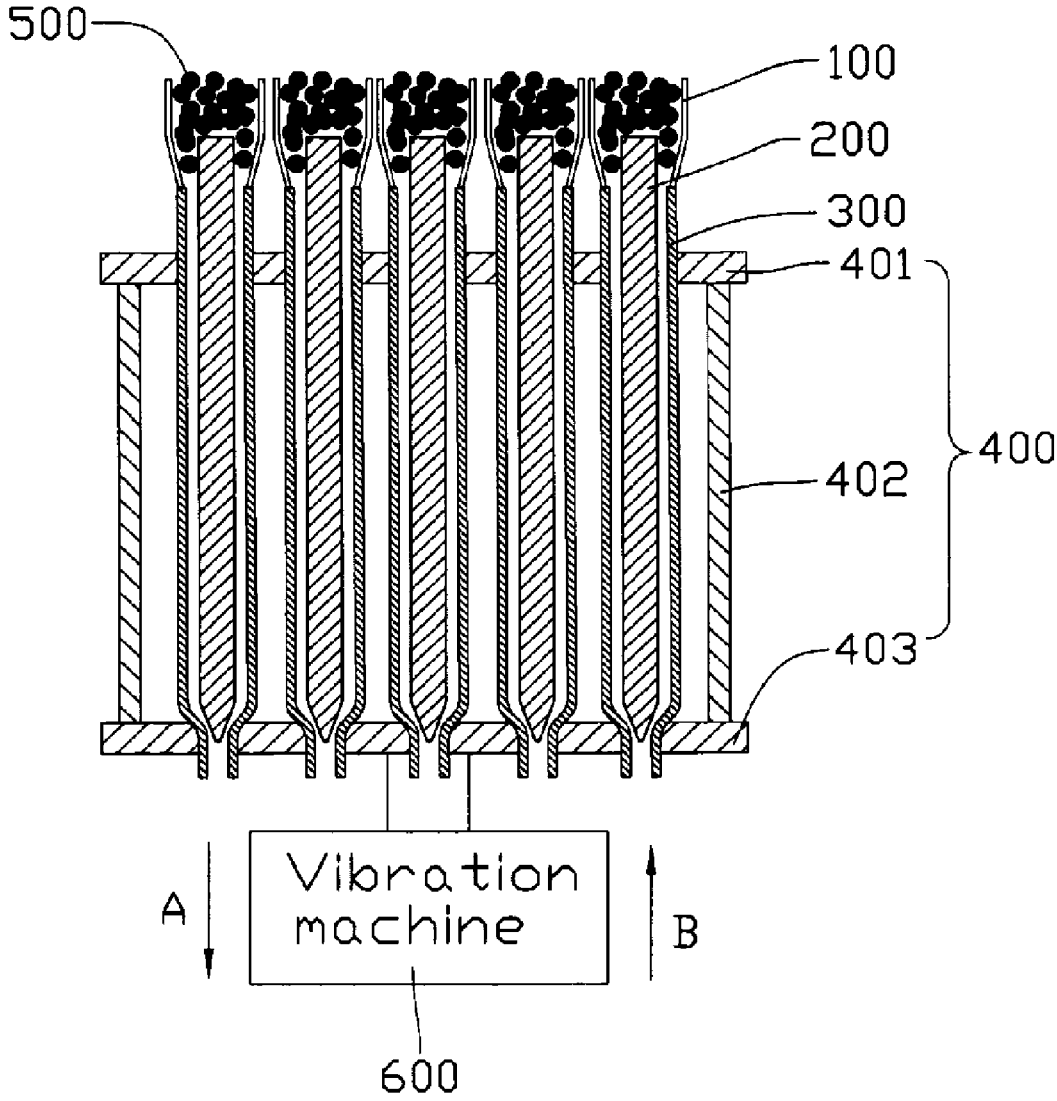
FIG. 1 is a longitudinal cross-sectional view of a powder feeding apparatus in accordance with a first embodiment of the present invention.

FIG. 1 illustrates a powder feeding apparatus of manufacturing a heat pipe in accordance with a first preferred embodiment of the present invention. The powder feeding apparatus comprises a vibratory tray 400. The tray 400 mechanically connects with a vibratory source 600 such as a vibratory machine located under the tray 400, for providing vibration to the tray 400 when feeding powder 500 into a plurality of pipes 300 positioned in the tray 400. The tray 400 comprises opposite upper and lower supporting boards 401, 403 at top and bottom thereof, and a pair of spaced sidewalls 402 connecting with corresponding ends of the upper and lower supporting boards 401, 403. The upper and low supporting boards 401, 403 define a plurality of corresponding through holes (not labeled) therein, wherein a diameter of each of the holes of the upper supporting board 401 is larger than that of each of the holes of the lower supporting board 403. The pipes 300, each having a cylindrical body (not labeled) and a lower end (not labeled) tapered from the body, are positioned in corresponding holes of upper and lower supporting boards 401, 403. An outer diameter of the body of each pipe 300 is smaller than that of a corresponding hole of the upper supporting board 401, but larger than that of a corresponding hole of the lower supporting board 403. A diameter of the lower end of each pipe 300 is smaller than that of a corresponding hole of the lower supporting board 403. The lower end of each pipe 300 is accommodated in the corresponding hole of the lower supporting board 403. An upper end of each pipe 300 is accommodated in the corresponding hole of the upper supporting board 401. A mandrel 200 is coaxially inserted in a center of each pipe 300. A feeding funnel 100 is disposed at a corresponding upper end of each pipe 300, for feeding the powder 500 to the pipe 300. In use, the vibratory source 600 drives the tray 400 to vibrate along an axial direction of the pipes 300, as indicated by arrows A, B shown in FIG. 1. The vibratory source 600 is located under and connects with a middle of the lower supporting board 403 whereby when the vibratory source 600 drives the vibratory tray 400 to vibrate, amplitudes of vibration of the pipes 300 are substantially the same with each other. Accordingly, amounts of powder 500 feed into the pipes 300 during the vibration are substantially the same.

Figure 2:
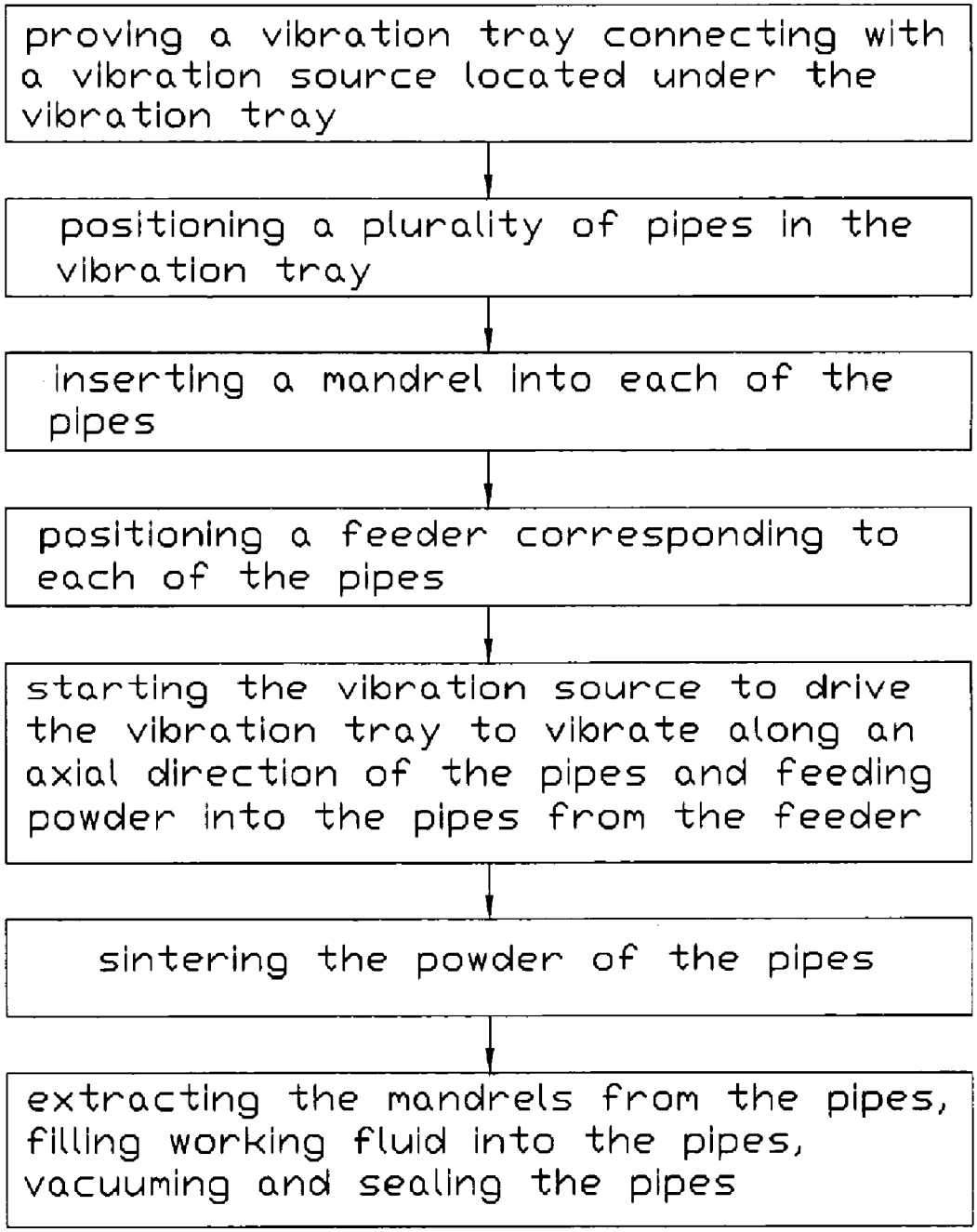
FIG. 2 is a flow chart of manufacturing a sintered wick heat pipe in accordance with the first preferred embodiment of the present invention.

Referring to FIG. 2, in accordance with the first preferred embodiment of the present invention, a powder feeding method of manufacturing a heat pipe in use of the powder feeding apparatus illustrated above comprises steps: 1) positioning the plurality of pipes 300 in the tray 400; 2) coaxially inserting the mandrel 200 into each pipe 300; 3) positioning the feeding funnel 100 to the upper end of each pipe 300; 4) filling the powder 500 such as copper or aluminum powder into the funnel 100; 5) starting the vibratory source 600 to drive the tray 400 to vibrate in a vertical plane, i.e., vibrating along an axial direction of the pipes 300. By this, the powder 500 is fed into a space between the mandrel 200 and the pipe 300.

According to the powder feeding apparatus and method of manufacturing a heat pipe, the vibratory source 600 is located under the tray 400 and drives the tray 400 to vibrate in the axial direction of the pipes 300, thereby driving the pipes 300 in the tray 400 to vibrate with substantially the same amplitude in the vibrating direction. Consequently, the pipes 300 in a same lot have substantially the same amount of powder filled therein.

After feeding the powder 500 into the pipes 300, the pipes 300 are then subjected to following steps to become heat pipes: 1) sintering the powder 500 in the pipe 300 to a form wick structure attached to an inner wall of the pipes 300; 2) extracting the mandrels 200 out of the pipes 300, filling working media (liquid) into the pipes 300, vacuuming the pipes 300 and sealing the pipes 300. By these steps, the heat pipes with the sintered wick structures are produced.

Figure 3:
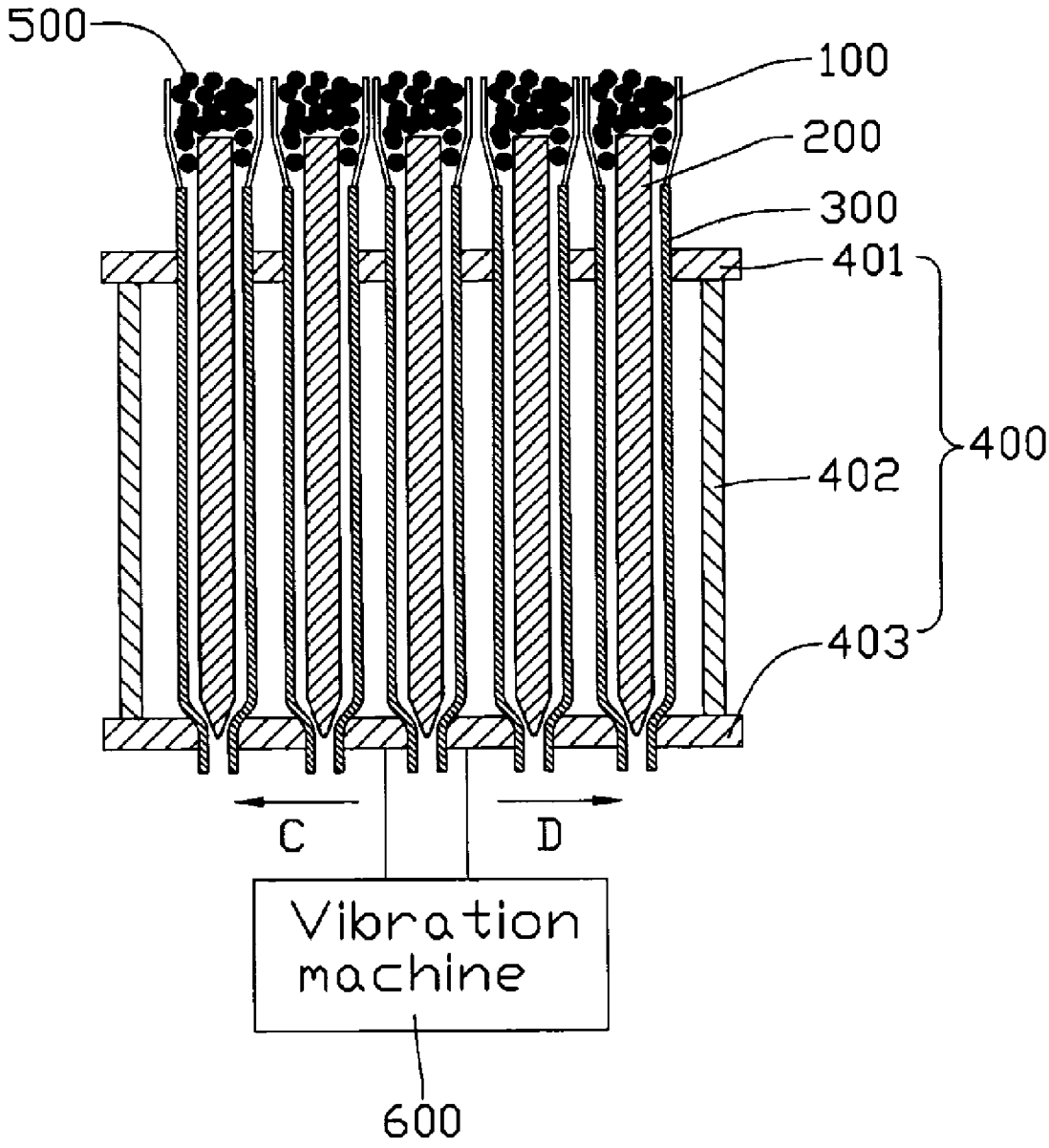
FIG. 3 is a longitudinal cross-sectional view of a powder feeding apparatus in accordance with an alternative embodiment of the present invention.
Figure 4:
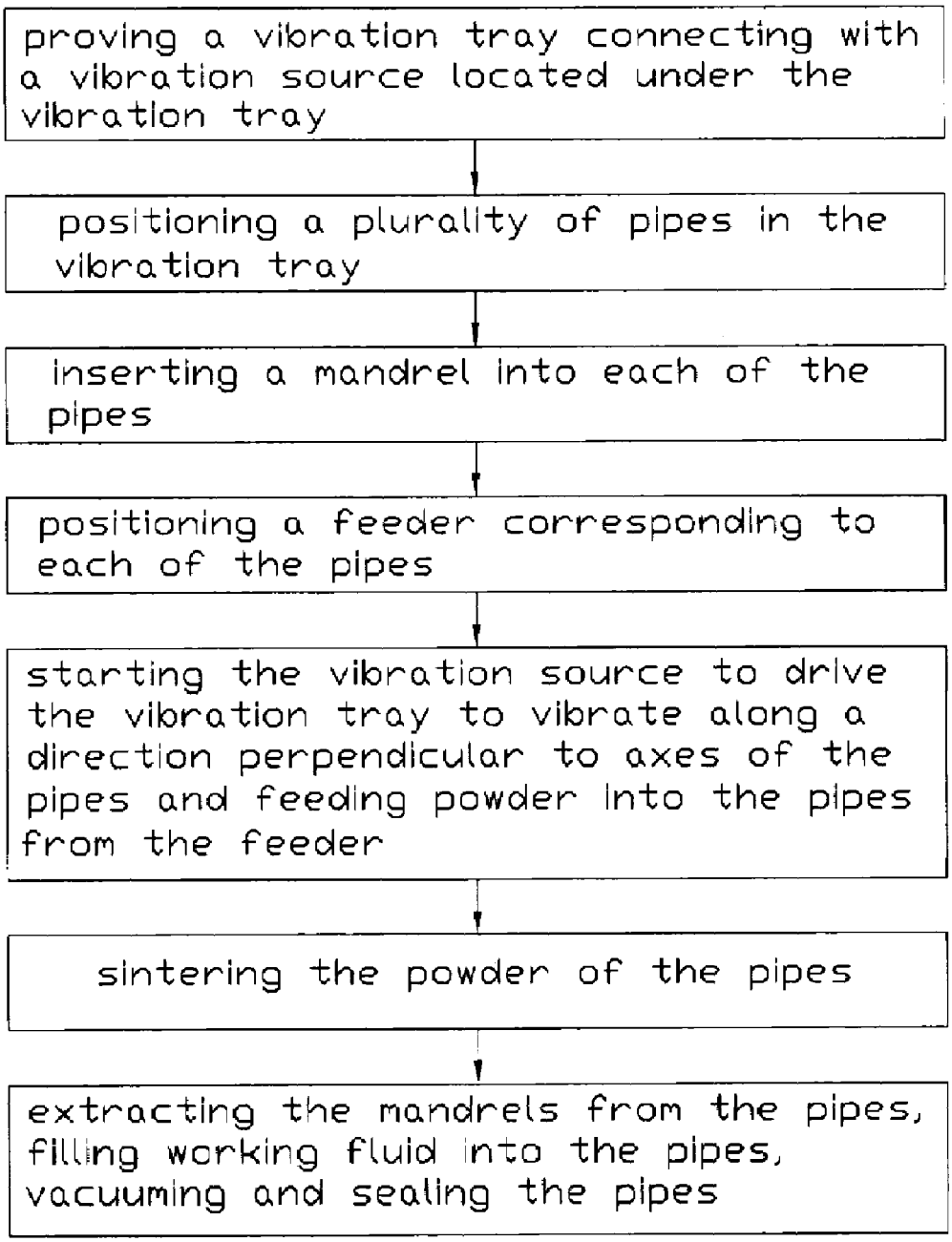
FIG. 4 is a flow chart of manufacturing a sintered wick heat pipe in accordance with the alternative embodiment of the present invention.
Figure 5:
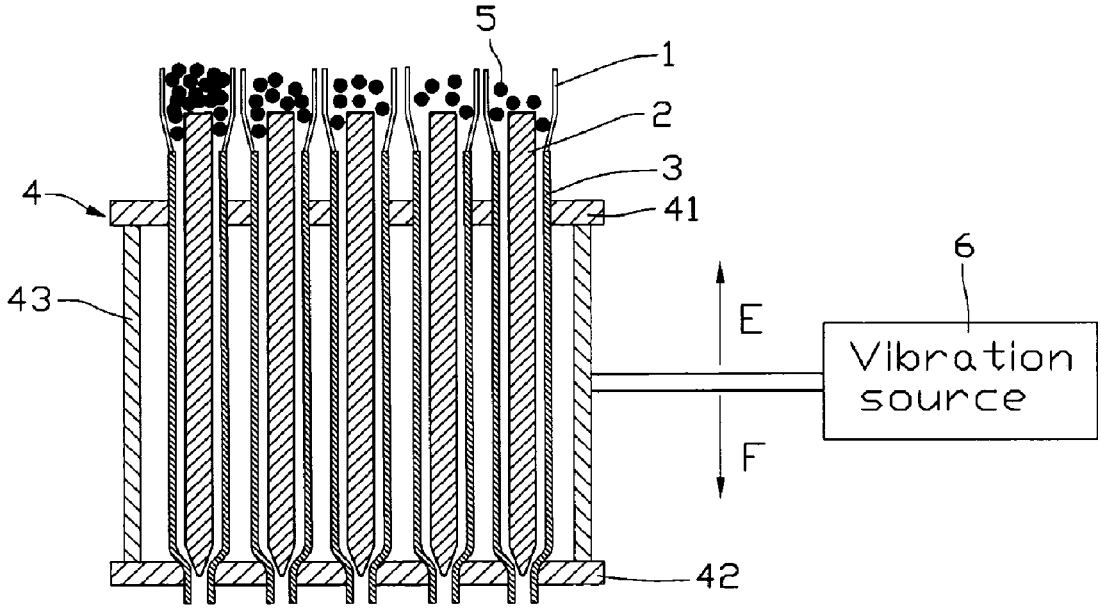
FIG. 5 (PRIOR ART)
FIG. 5 is a longitudinal cross-sectional view of a powder feeding apparatus in accordance with the conventional art.

Referring to FIGS. 3 and 4, a powder feeding apparatus and method of manufacturing heat pipes in accordance with an alternative embodiment of the present invention is shown. The alternative embodiment is similar to the preferred embodiment with the vibration source 600 still located under the tray 400; the difference is that, in use, the vibratory source 600 drives the tray 400 to vibrate in a direction perpendicular to axes of the pipes 300, as indicated by arrows C, D shown in FIG. 3. In other words, the vibratory source 600 drives the vibratory tray 400 to vibrate in a horizontal plane in accordance with the alternative embodiment.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A powder feeding apparatus of manufacturing a heat pipe comprising:

a vibration tray comprising a supporting board;

a vibration source located under the vibration tray for driving the vibration tray to vibrate;

a plurality of pipes positioned in the supporting board of the vibration tray;

a mandrel coaxially inserted into each of the pipes; and a feeder located corresponding to an end of each pipe for feeding powder into the pipes;

wherein, the vibration tray vibrates with substantially a same amplitude in a vibration direction when feeding the powder into the pipes from the feeders;

wherein the vibration tray comprises upper and lower supporting boards each defining a plurality of through holes therein, the pipes being accommodated in the through holes; and wherein a diameter of each of the holes of the upper supporting board is larger than that of each of the holes of the lower supporting board of the tray.

2. The powder feeding apparatus of claim 1, wherein each of the pipes comprises a body and a lower end tapered from the body, and wherein a diameter of the body is smaller than that of the diameter of each of the holes of the upper supporting board, but larger than that of each of the holes of the lower supporting board, and a diameter of the lower end is smaller than that of each of the holes of the lower supporting board, and wherein an upper end of the body of each pipe extends through a corresponding hole of the upper supporting board, the lower end of each pipe extends through a corresponding hole of the lower supporting board.

3. The powder feeding apparatus of claim 2, wherein the vibration tray comprises two sidewalls connect corresponding ends of the upper and lower supporting boards thereof.

4. The powder feeding apparatus of claim 1, wherein the vibration source drives the vibration tray to drive along an axial direction of the pipes.

5. The powder feeding apparatus of claim 1, wherein the vibration source drives the vibration tray to vibrate along a direction perpendicular to axes of the pipes.

6. The powder feeding apparatus of claim 1, wherein the vibration source is located under and connects with a middle of the supporting board of the vibratory tray.

* * * * *